United States Patent [19]

Gallo et al.

[11] 4,078,356

[45] Mar. 14, 1978

[54] PACKAGING METHOD AND APPARATUS FOR GROUND COFFEE OR THE LIKE

[75] Inventors: Simeo Anthony Gallo; James Harold Williams, both of Baton Rouge, La.

[73] Assignee: Morning Treat Coffee Company, Inc., Baton Rouge, La.

[21] Appl. No.: 738,547

[22] Filed: Nov. 3, 1976

[51] Int. Cl.[2] ..... B65B 31/04

[52] U.S. Cl. ..... 53/22 A; 53/112 A; 426/410

[58] Field of Search ..... 53/22 A, 110, 112 A; 426/394, 410

[56] References Cited

U.S. PATENT DOCUMENTS

| | | | |
|---|---|---|---|
| 2,565,444 | 8/1951 | Waters | 53/112 A |
| 2,649,671 | 8/1953 | Bartelt | 53/22 A |
| 3,274,746 | 9/1966 | James et al. | 53/112 A X |
| 3,619,975 | 11/1971 | Johnson et al. | 53/110 X |
| 3,930,350 | 1/1976 | Reid | 53/22 A |

*Primary Examiner*—Travis S. McGehee
*Attorney, Agent, or Firm*—Brezina & Lund

[57] ABSTRACT

A method and an apparatus for packaging of ground coffee or a like material are provided in which an inert gas such as carbon dioxide is supplied to surround discrete quantities of the material carried in a longitudinally moving folded trough-like web of impervious material, the gas being supplied into a region in which the discrete quantities of material enter a sealing region in which portions of the folded web are sealed together ahead of, above and behind the discrete quantity of material. Important features relate to the covering over of the folded web to enclose a space therein as it enters the sealing region, to the guiding of the edges of the web to cause them to converge as they approach the sealing region and to the injection of the gas at an angle and with a flow rate and velocity such as to cause the gas to completely surround the material without displacing the material relative to the web. Nozzle means are provided in a cover having converging guide grooves in its lower surface, the nozzle being located between the grooves and at a point a short distance behind a point at which the grooves join. The edges of the web are in close proximity as they enter the sealing region and a narrow cover is provided at the sealing region to block entrance of air and exit of the gas. Additional features relate to the thorough mixing of gas with ground coffee in a bin, to the supply of gas into filler tubes and to the supply of gas into a web of an outer wrap material as it is being formed.

12 Claims, 8 Drawing Figures

PACKAGING METHOD AND APPARATUS FOR GROUND COFFEE OR THE LIKE

This invention relates to a packaging method and apparatus and more particularly to a method and apparatus for packaging of ground coffee or like materials subject to deterioration in the presence of oxygen. With the method and apparatus of this invention, ground coffee can be packaged in small packages of relatively inexpensive flexible material and with a very low oxygen content such that the coffee can be kept for prolonged periods of time, and such packages can be reliably produced at high production rates, with uniform high quality and low oxygen content.

BACKGROUND OF THE PRIOR ART

It has heretofore been proposed to package finely ground coffee in a bag or packet of a pervious filter material, similar to a tea bag, which can be placed in a cup or other container of hot water to be left to "brew" for a certain length of time and then removed for consumption of the coffee. There are problems with coffee in that, unlike tea, it rapidly deteriorates in the presence of the oxygen which is present in the atmosphere. In the Hiscock U.S. Pat. No. 3,330,668, issued July 11, 1967, a method is disclosed in which such packets are disposed in a sealed outer wrap of an impervious material, containing an inert gas such as carbon dioxide to surround the packet within the sealed outer wrap and to prevent exposure to oxygen and deterioration of the coffee. On an experimental basis excellent results can be obtained and, prior to this invention, a machine was constructed for the packaging of coffee and intended for using carbon dioxde in accordance with the teachings of the Hiscock patent.

In the machine so constructed, a web of a pervious filter material is folded along a longitudinal fold line to form a generally V-shaped trough, the web being supported by an endless conveyor structure having upwardly projecting fingers which receive the web at spaced points therealong. The web is then severed to form individual packets. The web then moves through a filling region in which predetermined quantities of ground coffee are supplied, thence to a sealing region in which portions of the web are adhered together ahead of, above and behind each discrete quantity of the ground coffee. Such packets are supported from above by fingers depending from another endless conveyor structure to be carried to move along and above a web of an impervious outer wrap material, also folded to form a generally V-shaped trough. The packets are gently lowered into the web of wrapping material to be disposed in longitudinally spaced relation therealong, the web of wrapping material being moved longitudinally toward a sealing region in which portions thereof are sealed together ahead of, above and behind each packet and the discrete quantity of coffee contained therein. The web of wrapping material is then severed to form individual packages which may be carried by further apparatus to be placed in suitable boxes.

It is impractical to try to operate such apparatus in an enclosed space filled with gas to be substantially free of oxygen, for various reasons including the fact that it is not possible to avoid occassional problems and jam-ups in the operation of the machine in the forming and handling of the relatively delicate and lightweight packets of coffee, especially when the machine is operated at high production rates of speed. Frequent access to the machine is a practical necessity.

To avoid operating the entire machine in an oxygen-free environment, attempts were made to "flood" the folded overwrap material with carbon dioxide, without substantial success, even with a very high rate of flow, at which freezing became a problem. Attempts to provide a cover in the sealing or crimping region did not produce satisfactory results and also resulted in problems because of the heat developed by the sealing or crimping apparatus.

SUMMARY OF THE INVENTION

This invention was evolved with the object of overcoming the problems with prior methods and apparatus and of providing methods and apparatus adaptable for the packaging of ground coffee or similar materials and of obtaining a package substantially free of oxygen and permitting storage for long periods of time without deterioration of the coffee.

Another object of the invention is to provide methods and apparatus for packaging in which packages can be produced which are substantially free of oxygen while at the same time, they can be economically produced at high volume production rates.

A further object of the invention is to provide improvements in the packaging of coffee or like materials which do not involve the addition of highly expensive equipment or prohibit normal servicing required to achieve high production rates.

In attempting to achieve satisfactory results, without operating the entire machine in an oxygen-free environment, it was discovered that greatly improved results could be obtained by supplying carbon dioxide into a bin and thoroughly mixing the ground coffee in the bin with the carbon dioxide to flush out all air. The bin is closed at the top and the carbon dioxide, being heavier than air, settles to the bottom and stays in surrounding relation to the particles at the lower end of the bin from which they are dispensed. This was found to be highly desirable in that the carbon dioxide gas apparently adheres to the particles of ground coffee and even though a quantity of the coffee may be exposed to the air, the air will not displace the carbon dioxide, especially that around interior particles, unless the material is exposed to the air for a substantial period of time.

Another feature which was found to produce an improvement in results was the supply of carbon dioxide into filler tubes used to supply the ground coffee from the bin and into the trough of the pervious filter material.

A further desirable improvement was found to be in the supply of carbon dioxide over the web of the outer wrap material at the point at which it is just being formed into a "V", where the angle between the two portions thereof became less than 90°.

A very important feature of the invention relates to the supply of the carbon dioxide, or another inert type of gas, downwardly into the web to surround each packet or quantity of coffee as it enters the sealing region so that when the portions of the web are sealed together, the resultant package is filled with the gas and any oxygen-carrying air is substantially eliminated. This feature is found to be extremely important and the use of this feature greatly reduces the oxygen content of the package.

In accordance with a specific feature, the portion of the web immediately behind the sealing region is closed over, as by a suitable cover, to form with the web portions a substantially closed tube receiving the inert gas and serving to minimize the entrance of air.

Another specific feature resides in gradually converging the upper edges of the pair of portions of a web together as they approach the sealing region, further minimizing the possibility of there being air in the formed package.

Still another specific feature is in the injection of the air angularly downwardly and forwardly toward the sealing region, preferably at an angle on the order of 45°, i.e. about midway between horizontal and vertical.

The velocity and flow rate of the gas are important, it being found that they should be sufficient to substantially completely fill the region around the coffee as it enters the sealing region, while the velocity should be low enough to avoid displacing the coffee relative to the web.

Preferably and in accordance with a further specific feature, nozzle means are provided in the form of an open-ended tube, preferably disposed at an angle of on the order of 45°, and having an inner diameter such as to provide the proper flow rate and velocity. The tube is supported in a cover structure having lower surface means in proximity to the upper edges of the web, and preferably having a pair of converging grooves receiving the edges of the web, with the nozzle means being located between such grooves a short distance behind a point at which the grooves converge to join in a single groove at the forward end of a cover structure.

Another specific feature is in the narrowing of the single groove to hold the upper edges of the web together as they enter the sealing region.

Still another specific feature is in the provision of a narrow cover extending over the edges of the web in the sealing region to inhibit the outer flow of gas from the package during sealing and to inhibit the inward flow of air.

All of the features are important but those relating to the supply of the gas into the web as the coffee moves into the sealing region are particularly important. It is also quite important to mix the gas with the coffee in the bin to flush out all air before quantities of the coffee are dispensed during the formation of the packets.

With the invention, it is possible to produce packages at a high volume production rate and with a consistent oxygen level which is extremely low, on the order of 1 percent or less.

This invention contemplates other objects, features and advantages which will become more fully apparent from the following detailed description taken in conjunction with the accompanying drawings.

DESCRIPTION OF A PREFERRED EMBODIMENT

Figure 1:
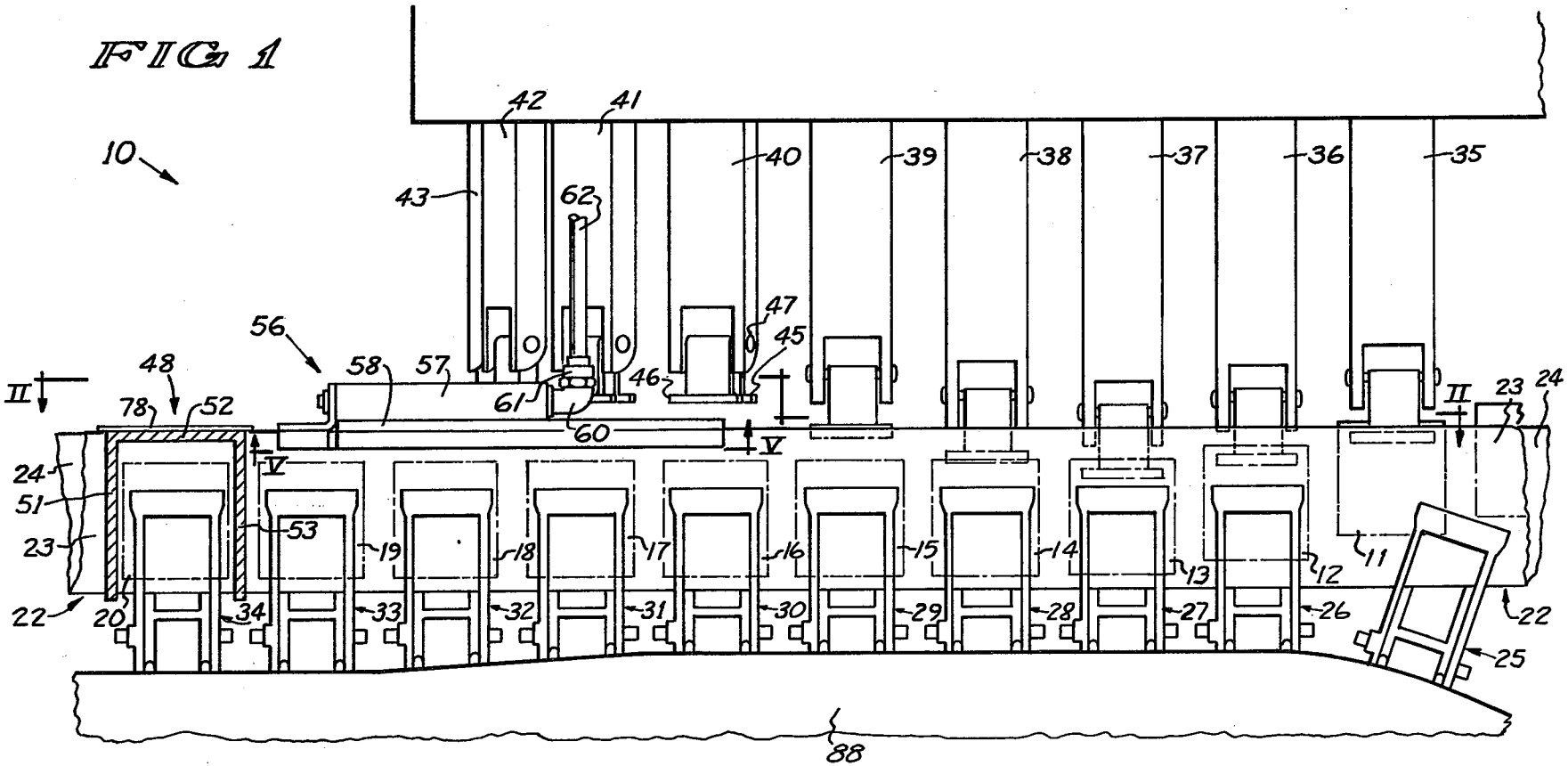
FIG. 1 is an elevational view of portions of a packaging machine in which packets are supplied into a web of an outer wrap material and in which the outer wrap material is sealed.

Reference numeral 10 generally designates packaging apparatus constructed in accordance with the principles of this invention. A portion of the apparatus is shown in FIG. 1 in which packets are in the process of being deposited in a web of an outer wrap material to be sealed. The packets, 10 of which are shown in broken lines in FIG. 1 and designated by reference numerals 11–20, are formed by apparatus not shown in FIG. 1 and each includes a predetermined quantity of finely ground coffee within an enclosure of pervious filter inner wrap material. The packets are deposited in a generally V-shaped trough formed by a web 22 of an impervious outer wrap material. A portion of the apparatus to the right of that shown in FIG. 1 and described hereinafter in connection with FIG. 7 folds the web to provide two portions 23 and 24 projecting upwardly from a central fold line or region.

The web 22 moves to the left to be supported by an endless conveyor structure including units linked together and supported by structure not shown, including sprocket wheels rotatable on spaced horizontal axes. Ten of such units 25–34 are shown in FIG. 1. The right-hand unit 25 is shown in a position in which it is being brought upwardly and to the left toward the position occupied by the next unit 26, the the unit 26 and the remaining units 27–34 are in horizontal alignment. Each of the units 25–34 includes upstanding fingers for receiving and supporting the web 22, the operation of such being described hereinafter in connection with FIGS. 3 and 4.

An overhead endless conveyor structure is provided which includes downwardly extending carriers having "picker" fingers at their lower ends adapted to engage the upper edge portions of the packets, nine of such carriers being shown in FIG. 1 and being indicated by reference numerals 35–43. The conveyor structure comprises a suitable mechanism, not shown, which includes a chain structure entrained on sprocket wheels rotatable on a vertical axis, for moving the carriers in an endless path including a linear portion above the web 22 and a portion extending arcuately about a vertical axis, the illustrated carriers 35–39 being in such linear portion of the path and the carriers 40–43 being in such arcuate portion of the path. The conveyor structure further includes means for moving the carriers vertically and means for controlling operation of the picker fingers. As can be seen in FIG. 1, a pair of fingers 45 and 46 are supported from a pivot shaft 47 on the lower end of carrier 40, the lower ends thereof being controllably movable toward and away from each other. Similar pairs of fingers are provided on the lower ends of each of the other carriers.

In the illustrated condition of the apparatus, the packet 11 is being held by fingers at the lower end of the carrier 35 and is being moved downwardly, the packet 12 being similarly held by fingers at the lower end of the carrier 36 and being at a lower position, and the packet 13 being at a still lower position at which it is supported by the web 22. At about the position of packet 13, the fingers of the corresponding carrier release so that all of the packets to the left of the packet 13 are supported by the web 22.

After release of the packets, the carriers are moved upwardly and thence in an arc about a vertical axis, eventually to return to the illustrated positions. Thus the carrier 38 is higher than the carrier 37, the carrier 39 is higher than the carrier 38 and the carriers 40–43 are still higher, to clear the web 22.

After release of the packets and before clearing the web, the carrier fingers, in the position of carriers 38 and 39, also serve to hold the upper edge portions of the web apart with a proper spacing to guide such edge portions into guide means hereinafter described.

The packet 20, at the extreme left in FIG. 1, is in a sealing position in which crimping means 48 press the web portions 23 and 24 together to seal them together ahead of, above and behind the packet 20, preferably with a heat seal, the web 22 being of a material capable of being sealed by heat.

The crimping means 48 comprises, for example, a pair of heads 49 and 50 on opposite sides of the web 22 moved toward each other to sandwich the web therebetween, preferably being moved longitudinally at the same linear speed as that of the web during the crimping operation. As seen in FIG. 1, the head 49 may include portions 51, 52 and 53 for engaging ahead of, above and behind a packet in the position of packet 20 and the other head 50 may include similar mating portions.

An additional portion of the apparatus, to the left of that illustrated in FIG. 1, severs the web between the packets to form individual packages which may be automatically boxed by additional portions of the apparatus.

A very important feature of the invention relates to the supply of an inert gas downwardly into the web 22 to flush out air and to surround each packet with the inert gas as it enters the sealing region. In accordance with this feature, a structure 56 is provided over the web behind the crimping means 48. The structure 56 includes a member 57 secured to the top of a plate 58 and having a passage 59 (FIG. 6) therein extending longitudinally, parallel to the web 22. An elbow fitting 60 is secured into the rearward end of the passage 59 and is connected through a coupling 61 to a tube 62 used to supply an inert gas, such as carbon dioxide. At the forward end of the passage 59, it intersects an opening in the member 57 which is aligned with an opening in the plate 58 and a tube 64 is disposed in such openings and extends downwardly and forwardly for the flow of the gas down into the web 22 to surround each packet as it moves down into the sealing region.

A specific feature is in the provision of guide means for causing the upper edges of the web portion 23 and 24 to converge as they approach the sealing region. In particular, a pair of members 65 and 66 are secured on the underside of the plate 58 and having converging inwardly facing surfaces 67 and 68 engagable with the outer surfaces of the upper edge portions of the web portions 23 and 24. A third member 70 is preferably provided, disposed between the members 65 and 66 and having opposite surfaces 71 and 72 facing the surfaces 67 and 68 to define grooves. The tube 64 extends through at the forward end of the member 70. Member 70 in insuring that the edge portions will converge smoothly, minimizes any wave action which might otherwise result.

The guide means further includes a closer nose fitting 73 (FIG. 5) secured to the forward end of the member 57 and plate 58 and including a horizontal portion 74 (FIG. 6) overlying the upper edges of the web portions 23 and 24 and having a pair of depending portions 75 and 76 (FIG. 5) the inner surfaces of which form extensions, the inner surfaces 67 and 68 of the members 65 and 66, being convergent to move the upper edges of the web portions 23 and 24 together as they move in proximity to the crimping means 48.

Another feature is in the provision of a finger or cover 78 over the upper edges of the web portions 23 and 24 between the crimper heads 49 and 50, operating to inhibit entrance of air and exit of the gas from the package. Finger 78 is preferably formed as an integral extension from the forward end of the horizontal portion 74 of the nose fitting 73.

The angle of the tube 64 (FIG. 6) is preferably on the order of 45°, i.e. mid-way between horizontal and vertical. The size of the tube 64 is also important in that it affects the rate and velocity of flow which should be sufficient to insure that the gas will fill the space around each packet during the sealing operation. At the same time, the velocity should be low enough to avoid displacing the packet relative to the web. Preferably, the tube 64 has an elliptical cross-sectional shape as illustrated, the large dimension being in the longitudinal direction, to obtain an area large enough to avoid an excessive velocity of flow while permitting placement of the lower end of the tube close behind the position at which the upper edges of the web portions are brought together by the closer nose fitting 73.

The structure 56 is supported by three rods including an inside rod 80 having a reduced diameter threaded upper end portion extending through an opening in the plate 58 with a wing nut 81 being threaded thereon and having a reduced diameter threaded lower end portion extending through an opening in a support plate 82 with nuts 83 and 84 being threaded on the rod 80 above and below the plate 82. The vertical position of the rod 80 is thus adjustable by adjustment of the nuts 83 and 84. The other two rods are not shown but the upper ends thereof extend through openings 85 and 86 in the outer side of the plate 58. The openings in the lower plate 82 are preferably in the form of transverse slots to permit angular adjustment. This arrangement permits adjustment of the height of the structure 56, adjustment of the relative height of the forward and rearward ends, adjustment of the height at the inside relative to the height at the outside and also angular adjustment and adjustable movement in the transverse direction. Such adjustments are highly desirable, to obtain positioning such as to promote smooth movement of the web portions without producing any wave action or distortions which might interfere with proper operation.

The dimensions of the structure 56 should be in approximately the same proportions of the packets and the web as illustrated in the drawings. The size of the packets may be approximately 2.25 inches by 2.875 inches, for example. A clearance of 1/16 inches should be provided between each side of the lower end of the tube and the facing portions of the surfaces 67 and 68. The tube 64 preferably has a mean diameter of about 0.25 inches and should extend about 0.375 inches into the opening of the web, while the grooves defined by surfaces 67, 68 and 71, 72 should preferably have a depth of about 0.5 inches. The surfaces 67, 68, 71 and 72 and especially the surfaces 71 and 72 should preferably not be in vertical planes but should be shaped as illustrated. The surfaces 67 and 68 are generally in planes converging to intersect at an imaginary line above the structure 56. The surfaces 71 and 72 are generally in planes converging to intersect at an imaginary line below the structure 56, so as to conform to the angle of the upper edges of the web portions 23 and 24. The overall length of the structure should be approximately in the proportion illustrated, extending as far as possible in the rearward direction without being in the path of the picker fingers and extending to about 1.75 inches from the crimper 48.

Figures 2, 3, 4, 5, 6:
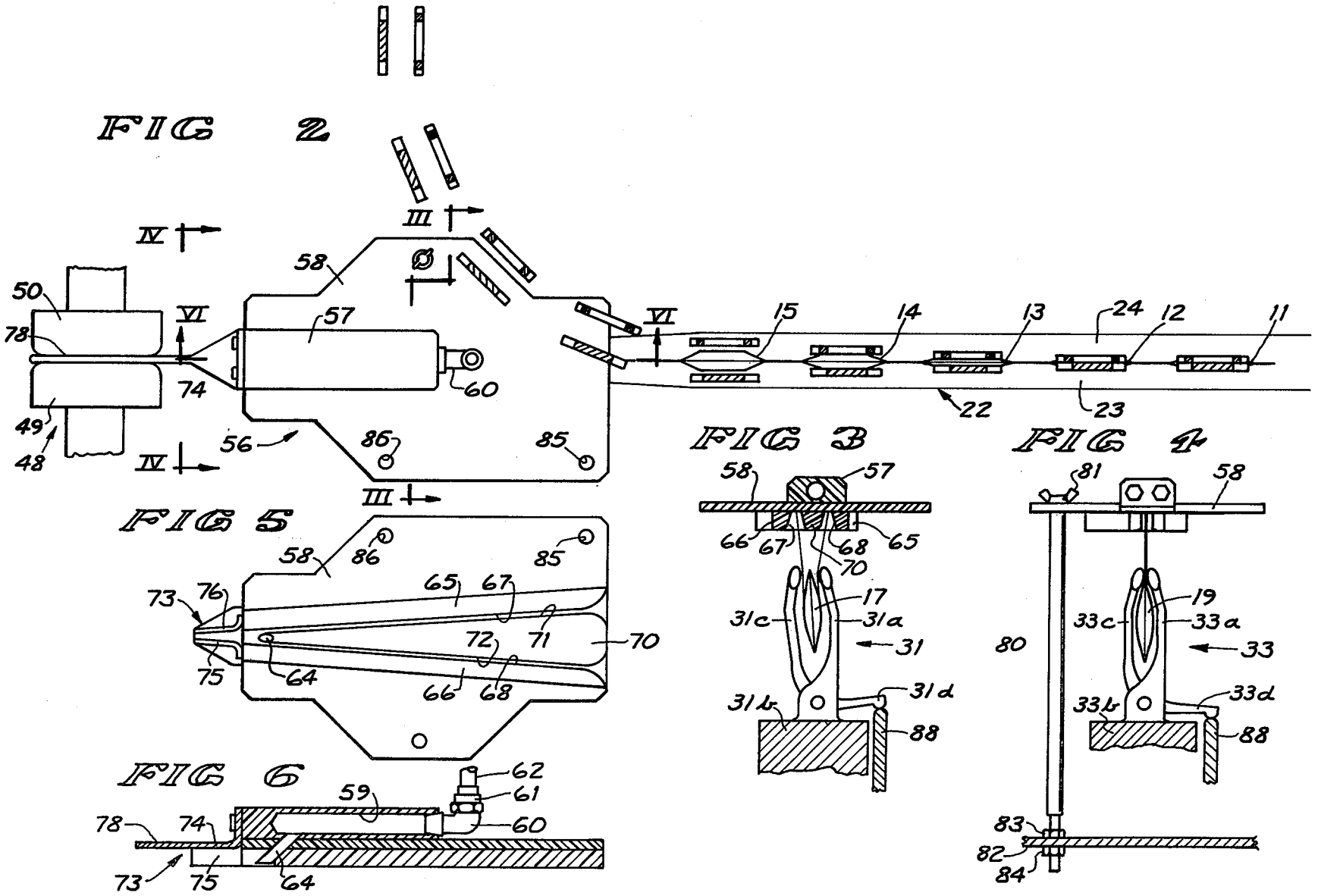
FIG. 2 is a sectional view taken substantially along line II—II of FIG. 1 constituting a plan view of certain portions of the structure illustrated in FIG. 1.
FIG. 3 is a sectional view taken substantially along line III—III of FIG. 2, showing the relationship of grooves in the underside of a cover structure to supporting fingers of a conveyor structure.
FIG. 4 is a sectional view taken substantially along line IV—IV of FIG. 2, showing a cover structure in end elevation and showing the positions of supporting fingers of a conveyor structure at the end of the cover structure.
FIG. 5 is a sectional view taken substantially along line V—V of FIG. 1, constituting a bottom plan view of a cover structure.
FIG. 6 is a sectional view taken substantially along line VI—VI of FIG. 2, through a cover structure of the apparatus.

The outside groove formed by surfaces 67 and 71 may be close to parallel to a central longitudinal vertical plane through the web support structure, while the inside groove formed by surfaces 68 and 72 may be at an angle such as to be about 1 inch from the outside groove at the rearward end and to intersect the outside groove at a point about 1.5 inches from the forward end of the cover plate 58. Such is the desired relationship when the units of the web conveyor are such that the outside fingers thereof are in fixed relation to a central vertical longitudinal plane of the conveyor while the inside fingers thereof are pivotal inwardly to control closing of the web 22 of the outer wrap material. As shown in FIG. 3, an outside finger 31*a* of the unit 31 is fixedly carried by a support portion 31*b* while an inside finger 31*c* is pivoted inwardly, a certain distance away from the finger 31*a*, a control arm 31*d* on the lower end of finger 31*c* being engaged with a cam plate 88, a suitable spring, not shown, being provided to urge the inside finger 31*c* in a clockwise direction. As the unit approaches the sealing region, the surface of the cam plate 88 is lower to allow the inside finger to move inwardly. Thus an inside finger 33*c* of the unit 33 is in closely spaced relation to the outside finger 33*a* thereof.

It is noted that the member 57, plate 58 and guide members 65, 66 and 70 are all preferably of a transparent plastic material to permit observation of the movement of the web and to facilitate accurate adjustment of the operation.

Figure 7:
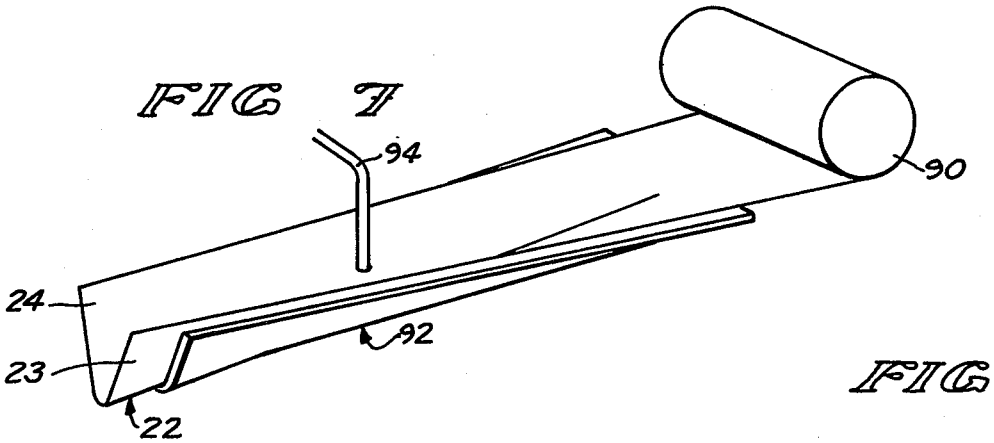
FIG. 7 diagrammatically illustrates an arrangement for forming a folded web of an outer wrap material.

FIG. 7 diagrammatically illustrates how the outer wrap web 22 is formed before reaching the portion of the apparatus shown in FIG. 1. The web is moved from a supply roll 90 over a forming plow 92 having portions on opposite sides of a central vertical plane, the angles of such portions being progressively changed to fold the web 22 into the two portions 23 and 24. At a point where the angle formed between the portions 23 and 24 is about 90° or somewhat less, a suitable inert gas such as carbon dioxide is supplied into the web through a tube 94 so that when the packets are moved into the web, there will be little or no air below the packets.

Figure 8:
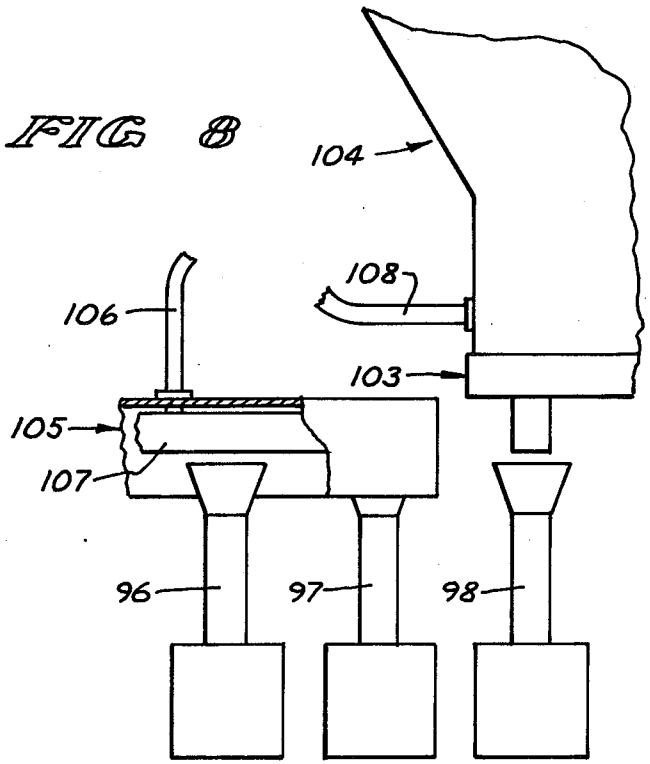
FIG. 8 diagrammatically illustrates a portion of apparatus used for filling packets with coffee.

FIG. 8 diagrammatically illustrates portions of the apparatus used for forming the packets. The packets are formed from a web of an inner wrap material in a manner somewhat similar to the formation of the outer wrap except that they are formed around the lower ends of filler tubes depending from an overhead conveyor structure, the filler tubes having funnel structures at their upper ends. Three of such filler tubes are shown in FIG. 8, designated by reference numerals 96–98, the inner wraps being supported by finger assemblies 99–101. The portions of the web are sealed together ahead of and behind the filler tubes and then are separated. When each tube reaches the position in which tube 98 is illustrated, it is under a dispenser unit 103 communicating with a bin structure 104 and a predetermined quantity of ground coffee is dispensed into the funnel structure at the upper end of the tube to flow into the packet. Thereafter, the filler tube is withdrawn upwardly, the upper ends of the packets are sealed together and the packet is picked up by picker fingers of the overhead conveyor structure of the apparatus shown in FIG. 1.

An important feature is in the provision of a shroud 105 over the filler tubes before they reach the dispenser with carbon dioxide being supplied through a tube 106 into a manifold 107 under the shroud 105, the manifold 107 having a multiplicity of small holes in its lower side producing a downward jet flow of carbon dioxide into the upper ends of the filler tube 97. Preferably the shroud 105 and manifold 107 may cover four filler tubes. The carbon dioxide flows downwardly into the lower ends of the filler tubes so that when the coffee is supplied through the tubes into the bag, the carbon dioxide will be carried with it into the packet.

Another feature, which is very important, is in the thorough mixing of carbon dioxide, or another suitable inert gas, with the coffee in the bin structure 104 to thoroughly flush out all of the air from the coffee prior to the filling operation. As diagrammatically illustrated, a tube 108 may be used to supply the gas into the structure and suitable mixing means, not shown, may be provided to stir up the coffee and allow the gas to flush out all of the air. The top of the bin structure 105 is preferably closed.

The thorough mixing of the gas with the coffee in the bin is highly desirable in that the gas adheres to the particles of the coffee and even though a quantity of the coffee may be exposed to the air in the packet, the air will not displace the gas around interior particles unless the material is exposed to the air for a substantial period of time.

With the invention it is possible to produce packages with a consistent oxygen level from 0.7 to 1.2 gross reading on an oxygen analyzer. At the same time, all of the equipment is accessible for servicing and any temporary jams that may be produced can be quickly corrected so that a high rate of production can be maintained. The arrangement further minimizes the amount of gas required, the gas being supplied only at key points. It is additionally noted that the structures for supplying the gas are quite simple in design and operation and can be provided at minimal expense, particularly when compared to the cost of the overall apparatus.

It will be understood that modifications and variations may be effected without departing from the spirit and scope of the novel concepts of this invention.

We claim as our invention:

1. In a method of packaging ground coffee or a like particulate material subject to deterioration in the presence of oxygen which includes the steps of effecting longitudinal movement of a web of impervious wrapping material folded along an intermediate longitudinal fold region into a pair of web portions extending upwardly from said fold region to upper edges in transversely spaced relation to thereby form an open trough, providing inner wrap enclosures, dispensing the particulate material through filler tubes into said inner wrap enclosures, depositing the filled inner wrap enclosures into said trough in longitudinally spaced relation therealong, and sealing said pair of web portions together ahead of, above and behind each filled inner wrap enclosure as it moves through a sealing region, the improvements comprising, in combination, the steps of thoroughly mixing an inert gas with the particulate material prior to dispensing thereof through said filler tubes, supplying an inert gas into said filler tubes in conjunction with dispensing of the particulate material into said inner wrap enclosures, and supplying an inert gas downwardly into said web in said region to surround each of said filled inner wrap enclosures as it moves into said sealing region.

2. In a method as defined in claim 1, the step of forming said web by gradually folding along an intermediate longitudinal fold region as the web is moved longitudinally, and supplying an inert gas into said web at a point at which the angle between said web portions is on the order of 90° or less.

3. In a method as defined in claim 1, said inert gas being injected downwardly into said sealing region with a flow rate and a velocity sufficient to substantially completely fill the region around each filled inner wrap enclosure as it enters said sealing region.

4. In a method as defined in claim 3, said velocity being low enough to avoid displacing the filled inner wrap enclosures relative to the web.

5. In apparatus for packaging ground coffee or a like particulate material subject to deterioration in the presence of oxygen including bin means for receiving the particulate material, means for forming inner wrap enclosures, means for dispensing of discrete quantities of the material from said bin, filler tube means for directing material from said dispensing means into said enclosures, means for effecting longitudinal movement of a web of impervious wrapping material folded along an intermediate longitudinal fold region into a pair of web portions extending upwardly from said fold region to upper edges in transversely spaced relation to thereby form an open trough, means for depositing the filled inner wrap enclosures into said trough in longitudinally spaced relation therealong, and sealing means for sealing said pair of web portions together ahead of, above and behind each discrete quantity of material as it moves into a sealing region, the improvements comprising, in combination, means for supplying an inert gas into said bin means for thorough mixing with the particulate material to flush out all air, means for supplying an inert gas into said filler tube means in conjunction with the dispensing of material therethrough, flow means for supplying an inert gas downwardly into said trough to surround each discrete quantity of material as it moves into said sealing region, cover means disposed over said web behind said sealing region and having lower surface means in proximity to the upper edges of said pair of web portions for cooperating with the adjacent portions of said web to define a substantially closed tubular portion receiving and containing said inert gas, said flow means comprising nozzle means in said cover means for injecting the inert gas downwardly and forwardly, and edge guide means on said lower surface means of said cover means for guiding the upper edges of said pair of portions of the web to gradually move said upper edges together as they approach said sealing region and for receiving and containing said inert gas.

6. In apparatus as defined in claim 5, means for gradually folding said impervious wrapping material to form said folded web, and means for supplying an inert gas into said web during folding at a point in which the angle between said pair of web portions thereof is approximately 90° or less.

7. In apparatus as defined in claim 5, said nozzle means being oriented at an angle of on the order of 45°.

8. In apparatus as defined in claim 5, said nozzle means being in the form of an open-ended tube having an inner diameter such as to provide a flow rate and velocity sufficient to substantially completely fill the region around said discrete quantity of material as it enters said sealing region while having a velocity low enough to avoid displacing said discrete quantity of material relative to said web.

9. In apparatus for packaging ground coffee or a like material subject to deterioration in the presence of oxygen including means for effecting longitudinal movement of a web of impervious wrapping material folded along an intermediate longitudinal fold region into a pair of web portions extending upwardly from said fold region to upper edges in transversely spaced relation to thereby form an open trough, means for depositing discrete quantities of the material into said trough in longitudinally spaced relation therealong, and sealing means for sealing said pair of web portions together ahead of, above and behind each discrete quantity of material as it moves into a sealing region, the improvement comprising, in combination, flow means for supplying an inert gas downwardly into said trough to surround each discrete quantity of material as it moves into said sealing region, cover means disposed over said web behind said sealing region and having lower surface means in proximity to the upper edges of said pair of web portions for cooperating with the adjacent portions of said web to define a substantially closed tubular portion receiving and containing said inert gas, said flow means comprising nozzle means in said cover means for injecting the inert gas downwardly and forwardly, and edge guide means for guiding the upper edges of said pair of portions of the web to gradually move said upper edges together as they approach said sealing region, said guide means comprising a pair of converging grooves in said lower surface means of said cover means.

10. In apparatus as defined in claim 9, said nozzle means being located between said grooves.

11. In apparatus as defined in claim 9, said grooves converging to join in a single groove at the forward end of said cover means.

12. In apparatus as defined in claim 11, said single groove being narrowed to hold the upper edges of said pair of web portions together as they enter said sealing region.

* * * * *